US005429368A

United States Patent [19]

Adams

[11] Patent Number: 5,429,368

[45] Date of Patent: Jul. 4, 1995

[54] PORTABLE PRACTICE PUTTING DEVICE

[76] Inventor: Thomas R. Adams, 30972 Loma Linda Rd., Temecula, Calif. 92592

[21] Appl. No.: 254,073

[22] Filed: Jun. 3, 1994

[51] Int. Cl.[6] ..... A63b 69/36

[52] U.S. Cl. ..... 273/192; 273/176 F

[58] Field of Search ..... 273/176 F, 192, 176 B, 273/35 R, 185 R, 187.1, 191 R, 195 R

[56] References Cited

U.S. PATENT DOCUMENTS

| | | | |
|---|---|---|---|
| 1,856,816 | 5/1932 | Luddy | 273/176 F |
| 3,831,949 | 8/1974 | Henning | 273/176 B |
| 4,230,319 | 10/1980 | Lindner | 273/192 |
| 4,596,391 | 6/1986 | Carolan | 273/176 B |
| 4,826,174 | 5/1989 | Hoyt | 273/192 |
| 4,953,865 | 9/1990 | Coombs et al. | 273/192 |
| 5,011,154 | 4/1991 | Bowen | 273/192 |

FOREIGN PATENT DOCUMENTS

| | | | |
|---|---|---|---|
| 472225 | 6/1969 | Switzerland | 273/176 F |

*Primary Examiner*—Mark S. Graham
*Attorney, Agent, or Firm*—Charles C. Logan, II

[57] ABSTRACT

A portable practicing putting device having a plurality of elongated panels that are connected together by hinges to form an elongated structure. A sheet of grass-like material is bonded to the top surface of the panels and it has a putting hole portion having a golf ball receptacle in it. An elongated strip portion extends to the front end of the elongated structure. A putting stroke zone is formed adjacent the front end of the elongated structure and it has a plurality of lines of golf tee apertures extending parallel to the putting stroke zone. The golf tees are placed into the particular lines of apertures that would have a spaced width apart closest to that of the diameter of the putter head. When not in use, the practice putting device can be folded up into a compact closed state.

9 Claims, 1 Drawing Sheet

10
12
13
14
16
17
20
22
24
26
30
40
42
44
50
52
53
60
62
64
W1
L1
L2
L3
L4

PORTABLE PRACTICE PUTTING DEVICE

BACKGROUND OF THE INVENTION

The invention relates to the field of golf and more specifically to a portable device for practicing putting.

A golfer uses his putter more than any other club in his golf bag when playing a round of golf. In many instances between 30 to 40 percent of a golfer strokes are with his putter. It is therefore important for a golfer to improve his putting skill as much as possible. One of the major errors committed by a golfer in the putting stroke is failure to keep the face of the putter perpendicular to the line of travel of the putter throughout their entire stroke.

Many practice devices have been designed and marketed to improve a person's putting stroke. The Brandell U.S. Pat. No. 3,558,139 has an elongated carpet runner whose rear end is positioned in a box carton having a golf ball receptacle.

The Jeffery U.S. Pat. No. 4,017,084 is directed to a combination putting and chipping device. It has a carpet that is mounted on a roller in its receptacle that can be pulled out to any desired length through an aperture in the bottom of a receptacle. The carpet also has linear dimensions marked on its top surface.

The Ren U.S. Pat. No. 4,368,888 is directed to a golf putting device that has a plurality of panels that can be placed end to end and a one-piece flexible carpet secured thereover. These panels can be folded on each other to form a compact storage configuration. The different panels have different point values on them to allow different players to pit their putting skills against each other.

The Buenzle U.S. Pat. No. 3,843,136 is directed to a practice putting device having an elongated playing mat of flexible resilient material and having a golf ball cup mounted adjacent its opposite ends.

The Scott U.S. Pat. No. 3,936,055 discloses a golf shot practice stage comprising a frame having side panels which define "green" and "fairway" playing surfaces. The panels can be positioned at different angles to the horizontal, to enable practice with different ball lies. This structure is foldable into a compact form for storage.

The Carolan U.S. Pat. No. 4,596,391 is directed to a portable putting device. It has obstacle placement segments such as those used in miniature golf. When the device is not in use it can be disassembled and packed into a compact container.

The Mull U.S. Pat. No. 5,261,670 is directed to a putting stroke developer. The target element has a base surface that rests on a putting surface as well as having a vertically oriented accurately curved, relatively hard golf ball rebounding surface designed to produce a rebound that will indicate the accuracy of the line and force of a putt relative to the likelihood that the putt would have successfully landed within a regulation golf hole.

It is an object of the invention to provide a novel portable practice putting device that has been designed to help a golfer learn to make a putting stroke that maintains the face of the putter perpendicular to the line of travel of the putter during the critical stages of the stroke.

It is also an object of the invention to provide a novel portable practice putting device that is compact enough that it can be carried in a briefcase or suitcase when traveling.

It is another object of the invention to provide a novel portable practice putting device that is economical to manufacture and market.

It is an additional object of the invention to provide a novel portable practice putting device that simulates the surface of the green of a golf course.

SUMMARY OF THE INVENTION

The novel portable practice putting device has a plurality of panels that are positioned end to end to form an elongated structure. The front and rear end of adjacent panels have hinges to secure the respective panels together. A sheet of grass-like material covers the top surface of the structure. The sheet of grass-like material has a putting hole portion having a golf ball receptacle in its center. A strip of the grass-like material extends to the front end of the elongated structure to the putting stroke zone. On each of the lateral sides of the putting stroke zone are formed a plurality of lines of apertures that are parallel to the axis of the elongated structure. These lines are laterally spaced from each other a predetermined distance. Pins in the form of golf tees are inserted into two of the longitudinally extending lines of apertures. The particular lines that would be chosen is determined by the width of the putter the person is using. The narrowest spacing between the lateral lines of golf tees would be chosen for improving the golfers putting stroke. The intent of the device is to teach the golfer to develop a straight back stroke followed by a straight through stroke while always maintaining the face of the putter perpendicular to the line of travel of the putter.

The portable practice putting device has been designed with a plurality of panels having predetermined lengths that allow them to be folded upon each other to provide a compact closed state that allows the device to be carried in a briefcase or suitcase whose width is as little as 18 inches wide. There are a plurality of tee storage apertures on the lateral edges of one of the panels. An end plate is secured to the front end of the elongated structure to intercept or limit the travel of any golf ball that has been putted past the hole.

DESCRIPTION OF THE PREFERRED EMBODIMENT

Figures 1, 2, 3, 4:
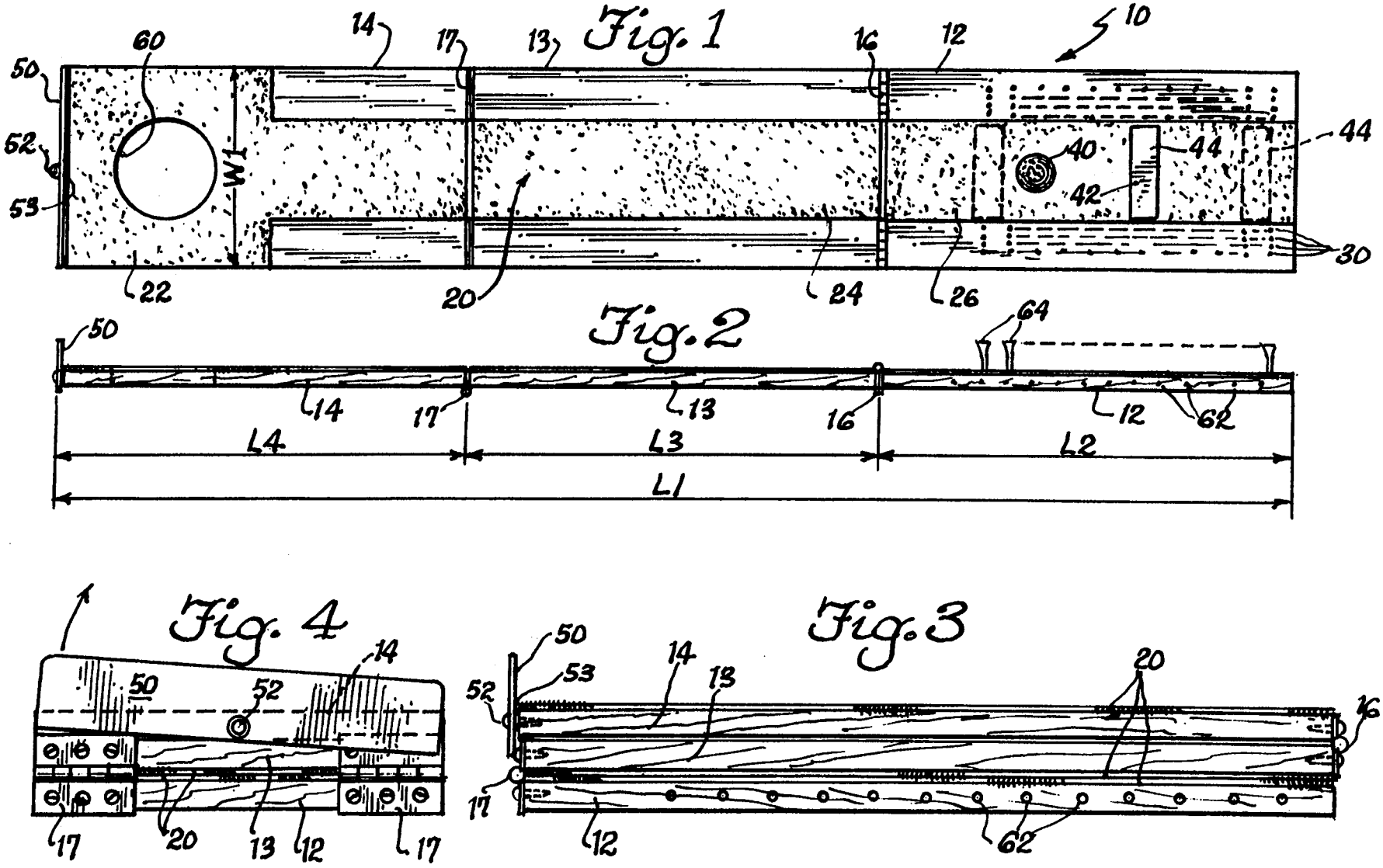
FIG. 1 is a top plan view of the portable practice putting device with its panels laid end to end to form an elongated structure.
FIG. 2 is a side elevation of FIG. 1.
FIG. 3 is a side elevation view of the portable practice putting device shown in its folded compact state.
FIG. 4 is an end elevation view of FIG. 3.

The novel portable practice putting device will now be described by referring to FIGS. 1–4 of the drawing. The portable practice putting device is generally designated numeral 10. The dimensions and number of panels may vary.

In the preferred embodiment illustrated, panels 12, 13 and 14 are respectively connected together by hinges 16 and 17. The overall length of the structure in its elongated state is L1 which is approximately 48 inches long. The width of the device would be approximately 8 inches wide. The diameter of the golf ball receptacle would be approximately 3½ inches.

A carpet or sheet of grass-like material 20 is adhesively bonded to the top surface of the perspective panels. It has a putting hole portion 22 and a strip portion 24. A putting stroke zone 26 is formed adjacent the front end of the elongated structure. Strip portion 24 has a width of approximately 3½ inches, On both lateral sides of putting stroke zone 26 are formed a plurality of lines 30 of apertures for receiving peg members in the form of golf tees 64. There would be approximately 12 apertures in each line and they would be spaced laterally from each other approximately ⅜ of an inch. As seen in FIG. 1, a golf ball 40 would be struck by the face 42 of putter head 44. With the putter head illustrated, the golf tees 64 would be placed in the apertures of the inner lines 30 on both sides of strip portion 24. Putters having a wider diameter require the golf tees 64 to be placed in different lines 30. The embodiment illustrated would be able to accommodate putters up to 6 inches wide. The stroke zone 26 would preferably be approximately 12 inches. Dotted lines in FIG. 1 show the putter head at its rear position and also its follow through position. If the golfer does not bring the putter head through perpendicular to its line of travel it will strike the tees outside the putting stroke zone. This provides a teaching reminder that the stroke has not been properly performed. Constant repetition of the putting stroke will result in the golfer making more of his putts and thereby lowering his score.

Panel 12 has a length L2, panel 13 has a length L3 and panel 14 has a length L4. As seen in FIG. 3, panel 14 is slightly longer than the other two panels. An end plate 50 is secured by a screw 52 and spacer 53 at its front end. End plate 50 performs two functions, one being to provide a barrier to stop any golf balls if they have been hit too hard past the golf ball receptacle 60. The second function that end plate 50 performs is when it is pivoted downwardly so that its front surface contacts the screws of hinge 16 and functions to hold the respective stacked panels together. The opposite lateral edges of panel 12 have longitudinally spaced tee storage apertures 62 for receiving golf tees 64.

What is claimed is:

1. A portable practice putting device comprising:

an elongated structure having a front edge, a rear edge, a left edge, a right edge, a top surface, a bottom surface, a predetermined length L1, a predetermined width W1, and a longitudinal axis;

said elongated structure having a putting hole portion on its top surface adjacent its rear edge, said putting hole portion having a golf ball receptacle;

said elongated structure having a putting stroke zone for a golf club known as a putter adjacent its front edge that extends a predetermined distance along the longitudinal axis of said elongated structure;

a sheet of grass-like material is located on said top surface and extending along said longitudinal axis from said putting stroke zone to said putting hole portion; and means for varying the width of said putting stroke zone comprising a plurality of lines of apertures on both lateral sides of said putting stroke zone for receiving peg members, said lines of apertures each being parallel to the longitudinal axis of said elongated structure so that putters having various widths can travel along said putting stroke zone by merely changing the rows of holes into which peg members would be inserted.

2. A portable practice putting device as recited in claim 1 further comprising means on at least one of said left or right edges of said elongated structure for storing a plurality of golf tees.

3. A portable practice putting device as recited in claim 1 further comprising an end plate secured to the rear edge of said elongated structure for limiting the travel of a golf ball that bas been putted.

4. A portable practice putting device as recited in claim 1 wherein L1 is no greater than 84 inches.

5. A portable practice putting device as recited in claim 1 wherein said elongated structure is formed of a plurality of panels that can be positioned end to end in an elongated state or stacked upon each other in a stored state.

6. A portable practice putting device as recited in claim 5 wherein there are three panels and they are connected together by hinges and none of said panels have a length greater than 18 inches so that said practice putting device can be folded into a collapsed state and carried in a briefcase or suitcase.

7. A portable practice putting device as recited in claim 5 wherein said putting stroke zone is at least 12 inches long.

8. A portable practice putting device as recited in claim 1 wherein said sheet of grass-like material has a T-shaped configuration.

9. A portable practice putting device as recited in claim further comprising peg members wherein said peg members are golf tees.

* * * * *